United States Patent [19]

Cudzik

[11] 3,967,750

[45] July 6, 1976

[54] EASY-OPEN WALL

[75] Inventor: Daniel F. Cudzik, Richmond, Va.

[73] Assignee: Reynolds Metals Company, Richmond, Va.

[22] Filed: July 1, 1975

[21] Appl. No.: 592,232

Related U.S. Application Data

[63] Continuation of Ser. No. 506,453, Sept. 16, 1974, abandoned.

[52] U.S. Cl. ..... 220/266; 220/269; 220/277

[51] Int. Cl.[2] ..... B65D 41/32

[58] Field of Search ..... 220/265, 266, 267, 268, 220/269, 277

[56] References Cited

UNITED STATES PATENTS

| | | | |
|---|---|---|---|
| 3,446,389 | 5/1969 | Brown | 220/269 |
| 3,730,379 | 5/1973 | Brown | 220/269 |
| 3,744,667 | 7/1973 | Fraze et al. | 220/269 |
| 3,749,275 | 7/1973 | Smith, Jr. et al. | 220/269 |
| 3,843,011 | 10/1974 | Perry | 220/269 |

*Primary Examiner*—George T. Hall
*Attorney, Agent, or Firm*—Glenn, Lyne, Gibbs & Clark

[57] ABSTRACT

An easy-open wall for a container and associated tab is provided and comprises an approximately U-shaped score line in the wall with the score line having a bight and a pair of extensions extending from the bight and having arcuate end lengths terminating in spaced ends. The spaced ends have a portion of the wall therebetween and the score line defines a panel which is completely severable from the wall while remaining attached at the wall portion to define an opening in the wall. The tab is attached substantially flatly against the wall and has a forward portion which overlies the panel adjacent the arcuate end lengths and has a rear portion with the rear portion being easily grasped and lifted to urge the forward portion against the panel to thereby sever the panel first along the arcuate end lengths and then progressively along the extensions and bight to move the panel within the container with the wall portion holding the panel securely to the wall.

20 Claims, 22 Drawing Figures

EASY-OPEN WALL

This is a continuation, division, of application Ser. No. 506,453 filed Sept. 16, 1974, now abandoned.

BACKGROUND OF THE INVENTION

In the highly competitive container industry there have been proposals heretofore to provide containers such as cans for carbonated beverages, for example, wherein each can has a tear strip which is designed to remain attached to its associated wall in order to minimize litter problems or injury of people likely to come into contact with such a tear strip if it could have been severed and separated from its can. Some of the cans proposed heretofore employ a tab, or the like, which engages the severable strip and pushes it within its associated can to define a dispensing opening yet keeps the tear strip attached to its associated wall. Two general problems with a can having this type of opening means are first that the forces which must be exerted by an associated tab device to provide the severing action are comparatively large and second the dispensing opening is often obstructed in an undesirable manner whereby complex tab devices and score lines have been proposed in an effort to solve these general problems.

SUMMARY

This invention provides an easy-open wall for a container of the character mentioned which minimizes the above-mentioned problems and a tab device capable of exerting a severing force of high magnitude. The easy-open wall comprises an approximately U-shaped score line in the wall with the score line having a bight and a pair of extensions extending from the bight and having arcuate end lengths terminating in spaced ends. The spaced ends have a portion of the wall therebetween and the score line defines a panel which is completely severable from the wall while remaining attached at the wall portion to define an opening in the wall. The tab is attached substantially flatly against the wall and has a forward portion which overlies the panel adjacent the arcuate end lengths and has a rear portion with the rear portion being easily grasped and lifted to urge the forward portion against the panel to thereby sever the panel first along the arcuate end lengths and then progressively along the extensions and bight to move the panel within the container with the wall portion holding the panel securely to the wall.

Other details, uses, and advantages of this invention will be readily apparent from the exemplary embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
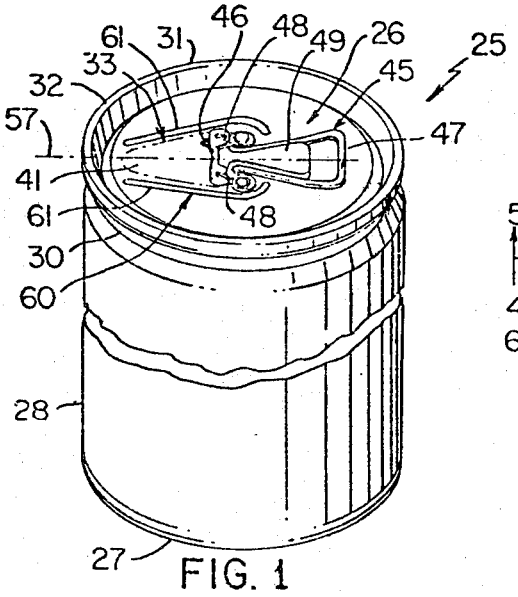
FIG. 1 is a fragmentary perspective view of an exemplary container which utilizes an easy-open wall of this invention as its top wall.
Figure 4:
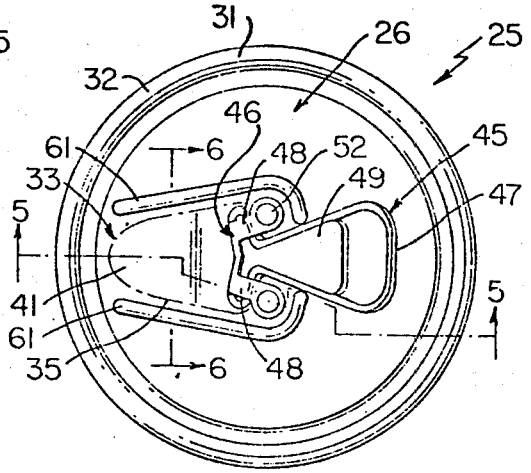
FIG. 4 is a top plan view similar to FIG. 2 illustrating the tab partially lifted causing the forward portion of the tab to be urged against the panel to produce partial severing of such panel first along arcuate end lengths of its U-shaped score line which define the maximum width of the panel.

Reference is now made to FIG. 1 of the drawings, which illustrates an exemplary container 25 of this invention which utilizes an easy-open wall shown as a top wall 26 made in accordance with this invention. The container 25 is preferably in the form of an all-metal container which may have some or all of its walls and components made of ferrous material and/or aluminous material; although, preferably the entire container 25 is made of an aluminous material with a bottom wall 27 and a side wall 28 thereof made as a single-piece unitary construction. To prevent chime ride the container 25 has a necked-in portion 30 and the easy-open top wall 26 may be suitably fastened in position using any technique known in the art; however, in this example such top wall is fastened in position by mechanical swaging action to define an annular bead 31 having a top surface 32 and the outside periphery of the annular bead 31 is such that it is within an imaginary right circular cylinder defined by an extension of the outside surface of the side wall 28.

Figure 8:
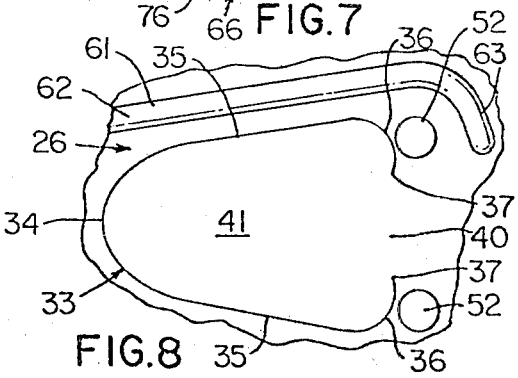
FIG. 8 is an enlarged, fragmentary plan view particularly illustrating the approximately U-shaped score line in the top wall, the panel defined thereby, and the integral rivets adjacent thereto for attaching an associated tab device.

The top wall 26 has an approximately U-shaped score line defined therein with such score line being designated generally by the reference numeral 33, also see FIG. 8, and the score line has a bight 34 and a pair of extensions 35 extending from opposite ends of the bight and has arcuate end lengths 36 terminating in spaced ends 37 with the spaced ends having a portion of the wall 40 therebetween. The score line 33 defines a panel 41 which is substantially completely severable from the wall 26 while remaining attached to the wall portion 40 to define an opening 44, shown completely defined in FIG. 9.

The top wall 26 has what may be considered a high mechanical advantage tab 45 which is particularly adapted to sever the panel 41 and such tab is basically solid throughout and is provided with flange means, to be described subsequently, whereby the tab 45 is used as a rugged lever. The tab 45 is roughly Y-shaped and comprises a forward portion which is designated generally by the reference numeral 46 and overlies the panel 41 and a rear portion 47 which is arranged remote from the panel 41 at a location substantially diametrically opposite from the bight 34 of the score line 33. The forward portion 46 is defined by a pair of comparatively short arms of the Y configuration and each arm is designated by the reference numeral 48 and the central leg of the Y-shaped tab 45 is designated by the reference numeral 49.

Figure 5:
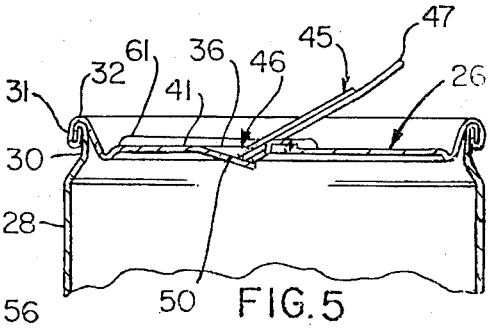
FIG. 5 is a fragmentary cross-sectional view taken essentially on the line 5—5 of FIG. 4.
Figure 9:
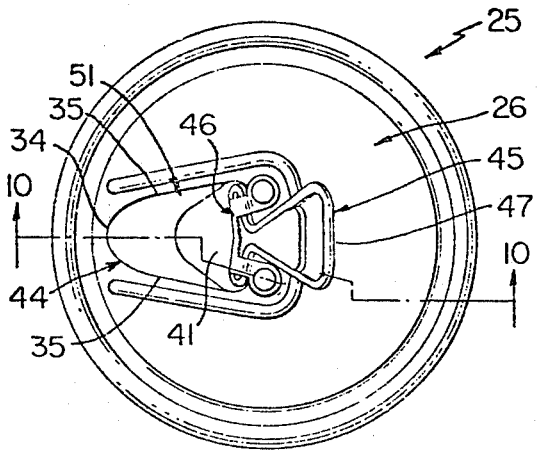
FIG. 9 is a view similar to FIG. 4 illustrating the tab lifted substantially vertically to completely define the opening in the top wall.

To open the top wall 26 the rear portion 47 or the tab 45 is easily grasped and lifted to urge the forward portion 46 against the panel 41 and thereby sever the panel 41 first along the arcuate lengths 36 and as illustrated at 50 in FIG. 5 then progressively along the extensions 35 of the U-shaped score line 33 and bight 34 to move the panel 41 within the container 28 as illustrated at 51 in FIG. 9 with the wall portion 40 holding the panel 41 securely to the wall.

The easy-open wall 26 has attaching means in the form of a pair of rivets, each designated by the reference numeral 52, for attaching the tab 45 to the wall 26 between its forward portion 46 and the rear portion 47. The rivets 52 and in particular the forward edges thereof, in essence, define an imaginary pivot line which is designated by the reference numeral 53 in FIG. 2 about which the high strength solid lever-like tab 45 is pivoted.

Figure 2:
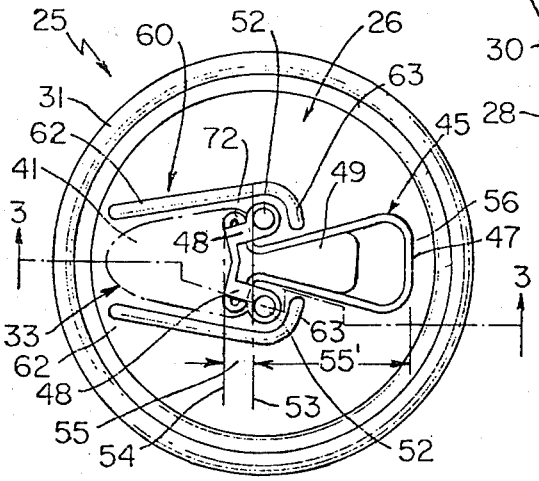
FIG. 2 is a top plan view of the container of FIG. 1.

As best seen in FIG. 2 the tab has front edge means shown as a pair of front edges 54 on its forward portion 46 which, with the tab 45 attached or riveted in position by rivets 52, are spaced a particular distance as indicated at 55 from the pivot line 53. The tab 45 has rear edge means shown in this example as a rear edge 56 which is spaced a substantial distance as indicated at 55' from the pivot line 53. The distance as indicated at 55' is generally of the order of eight times the distance indicated at 55, whereby upon lifting the rear portion 47 of the tab in the manner illustrated in FIGS. 5 and 10 a substantial mechanical advantage of roughly eight is provided. The high mechanical advantage of the tab 45 assures initial easy severing in the manner illustrated at 50 in FIG. 5 and then continued progressive severing along the extensions 35 and bight 34.

As will be apparent particularly from FIG. 8 the roughly U-shaped configuration of the score line 33 may be also considered as being roughly arrowhead shaped and the score line 33 and hence panel 41 defined thereby is symmetrical about a longitudinal axis 57, see FIG. 1. The tab 45 also has a longitudinal axis about which it is symmetrical and the longitudinal axis of the tab in this example coincides with the axis 57 whereby the panel 41 and the tab 45 have the common longitudinal axis 57.

As shown particularly in connection with FIGS. 1 and 2 of the drawings, the wall 26 has reinforcing ridge means provided therein as an integral part thereof and such reinforcing ridge means is designated generally by the reference numeral 60 and is comprised of a pair of roughly L-shaped ridges 61 with each L-shaped ridge having a long arm portion 62 and a comparatively shorter transverse arm portion 63 with the long arm portion being arranged substantially parallel to the extension 35 of the U-shaped score line 33.

Figure 6:
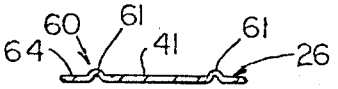
FIG. 6 is a fragmentary cross-sectional view taken essentially on the line 6—6 of FIG. 4.
Figure 12:
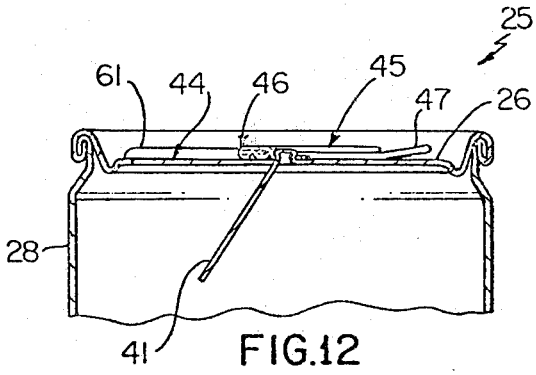
FIG. 12 is a fragmentary cross-sectional view taken essentially on the line 12—12 of FIG. 11.

Each L-shaped reinforcing ridge 61 is, in essence, in the form of an undulation, see FIGS. 6 and 12, provided in the wall 26 and extends upwardly from a main planar portion 64. Each L-shaped ridge 61 also has a substantially uniform wall thickness which is approximately equal to the wall thickness of the remainder of the easy-open top wall 26. The reinforcing ridges 61 serve to rigidify the top wall 26 and prevent deflection thereof especially along the score line 33 to thereby make it easier to sever the panel 41.

Figure 7:
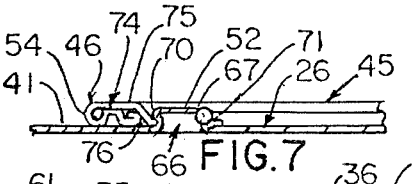
FIG. 7 is an enlarged, fragmentary, cross-sectional view illustrating one of a pair of rivets which is used to fasten the tab of FIG. 1 in position.
Figure 3:
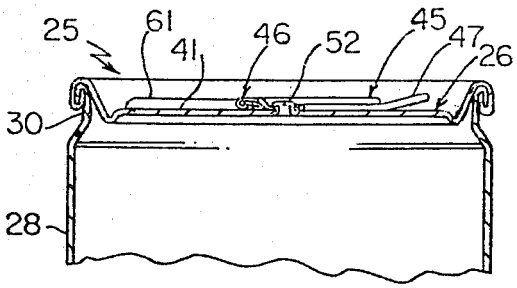
FIG. 3 is a fragmentary cross-sectional view taken essentially on the line 3—3 of FIG. 2.

As best seen in FIG. 7 of the drawings each rivet 52 is defined as an integral part of the wall 26 and each rivet is in the form of a substantially cylindrical member having an inverted hat-like or cup-like shape as indicated at 66 and a wall thickness which is substantially equal to the thickness of the remainder of the wall 26. The tab 45 has a pair of openings each designated by the same reference numeral 67 and such openings are adapted to have an associated rivet inserted therethrough in a manner known in the art whereupon the rivets 52 are suitably formed to define heads 70, and, each head 70 overlaps the metal at 71 adjacent each opening 67 whereby the rivet heads 70 hold the tab attached to the top wall 26 in a known manner.

Although the rivets 52 are shown as an integral part of the top wall 26, it will be appreciated that such rivets need not necessarily be defined as an integral part of such top wall but may be separate members. In addition, instead of using rivets 52 as attaching means, the tab may be suitably fixed in position as by welding, adhesive means, or the like, so that the front edges 54 thereof are arranged in the manner shown in the drawing.

As will be apparent, particularly from FIG. 8 of the drawings, the arcuate lengths 36 are concave on a side thereof arranged toward the bight 34 of the U-shaped score line 33 whereby they are correspondingly convex on an opposite side thereof which is arranged away from such bight 34. The integral rivets are arranged outwardly of and adjacent to the convex arcuate lengths so that upon fastening the tab 45 in position utilizing the rivets 52 and in the manner illustrated in FIG. 7, the forward portion 46 of the tab 45 is arranged with its front edges 54 immediately adjacent and within the concave portions of the arcuate lengths 36 so that maximum pressure is applied to the tab immediately adjacent the arcuate lengths 36 to sever the initial openings as illustrated at 50 in FIG. 5 upon lifting the rear portion 47 of the tab 45. It will also be seen that the front edges 54 of the forward portion 46 are adjoined by arcuate portions of the forward portion 46 as illustrated at 72 in FIG. 2. The arcuate portions at 72 are convex while being smaller in radius than the concave sides of the arcuate lengths 36 of the score line 33 so that they are nested therewithin.

As seen particularly in FIGS. 2 and 7 of the drawings, the forward portion 46 of the tab 45 has a pair of double thickness portions, each designated by the reference numeral 74, with each portion 74 being arranged within the concave side of an associated arcuate length. The double thickness portions are defined by bifolding metal extensions 75 having grommet-like terminal end portions and each opening 67 is provided in an associated grommet-like portion 75.

The grommet-like portion 75 is a single thickness portion and overlies, i.e., is bifolded over, the remaining portion of the forward portion 46 of the tab 45 and is angled downwardly as indicated at 76, so that the bottom surface thereof is substantially coplanar with the bottom surface of the front edges 54. This enables easy attachment of the tab 45 to the top wall 26 and also assures that once the tab 45 is lifted by lifting the rear portion 47 thereof the pivoting action, in essence, results in the grommet-like portion 75 urging against the metal arranged therebeneath exerting substantial pressure to provide severing of the panel 41 along the score line 33.

Figure 14:
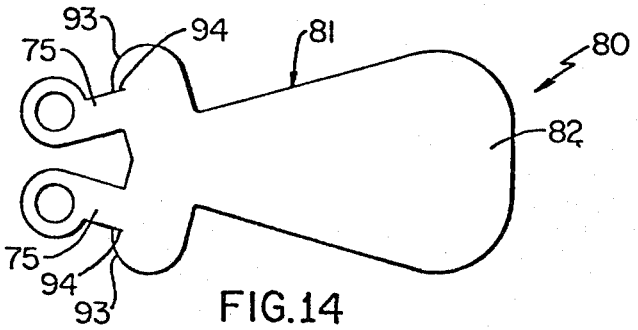
FIG. 14 is a plan view of a flat sheet metal blank which may be used to make the tab of FIG. 1.
Figure 17:
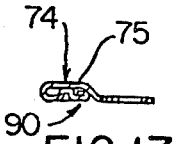
FIG. 17 is a cross-sectional view taken essentially on the line 17—17 of FIG. 15.

Having described the main components of the container 25 and the easy-open top wall 26, the detailed description will now proceed with a detailed description of the improved tab 45 which, as previously mentioned, is in the form of a high-strength lever capable of providing a mechanical advantage generally of the order of 8 to 1 and for this description reference is made to FIGS. 14–17 of the drawings. The tab 45 is preferably made from a single piece of metal in the form of a blank as shown in FIG. 14 and such blank is designated by the reference numeral 80. The blank 80 has a peripheral outline, as indicated at 81, which defines the main peripheral outline of the blank and a narrow peripheral portion of the blank is folded around the main single leg of the Y-shaped configuration to define a high-strength flange and such flange is designated by the reference numeral 82.

Figure 15:
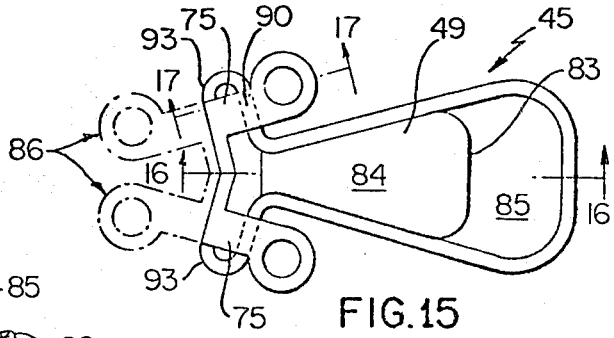
FIG. 15 is a plan view of the blank of FIG. 14 completely formed and showing by dotted lines the positions of grommet-like portions thereof prior to bending in position.
Figure 16:
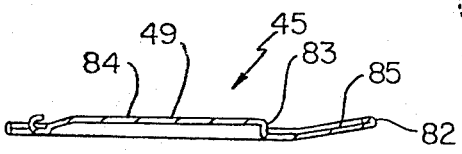
FIG. 16 is a cross-sectional view taken essentially on the line 16—16 of FIG. 15.

As seen in FIGS. 15 and 16 the tab 45 has another flange-like portion 83 which extends across the single leg portion of the Y-shaped configuration and serves as a reinforcing beam across the width of the main body 49 of the tab 45; and, the main body 49 of this example is a solid metal structure on opposite sides of the beam-like flange 83 and as shown at 84 and 85.

As will be apparent, particularly from FIG. 15 of the drawings, the grommet-like extensions 75 are initially in the dotted line positions illustrated at 86 whereupon they are bifolded into their final positions as shown by solid lines in FIG. 15 to define the double thickness portions 74. The tab 45 also has a triple thickness portion as indicated at 90 in FIG. 17 at the location where the grommet-like portion 75 is angled downwardly as illustrated at 76 whereby the forward portion of the tab 45 has a maximum strength and rigidity.

Figure 13:
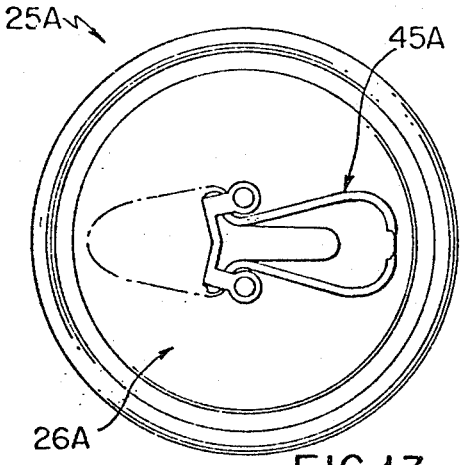
FIG. 13 is a plan view similar to FIG. 2 illustrating another exemplary container having another embodiment of a top wall and tab.

Another exemplary embodiment of the container of this invention is illustrated in FIG. 13 of the drawing by a top plan view whereby only the top wall thereof is shown. The container illustrated in FIG. 13 is similar to the container 25; therefore, such container will be designated by the reference numeral 25A, its top wall 26A, and component parts of such top wall which are similar to corresponding parts of the top wall 26A will be designated in the drawing by the same reference numeral as in the top wall 26 of container 25 (whether of not such components are mentioned in the specification), followed by the letter designation A and not described again in detail.

The top wall 26A differs from the top wall 26 only in the fact that its tab 45A is different from the tab 45; however, it will be appreciated that the tab 45A may be used interchangeably with the tab 45 and a detailed description will now be made of the tab 45A, and for this description particular reference is made to FIGS. 18–21 of the drawings.

Figure 18:
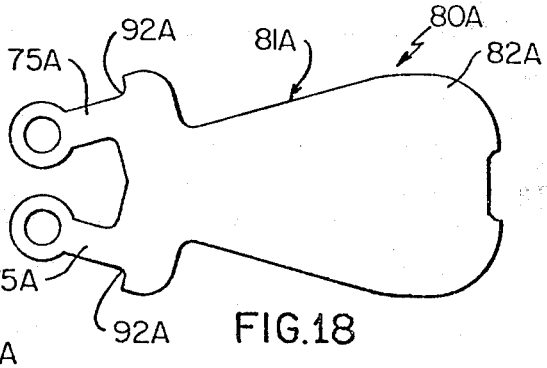
FIG. 18 is a plan view similar to FIG. 14 illustrating a blank which may be used to make the push tab used on the top wall of FIG. 13.

The tab 45 is also preferably made from a single piece of metal in the form of a blank as shown in FIG. 18 and such blank is designated by the reference numeral 80A. The blank 80A has a peripheral outline, as indicated at 81A, which defines the main peripheral outline of the blank and a narrow peripheral portion of the blank is folded around the main single leg of the Y-shaped configuration to define a high-strength flange and such flange is designated by the reference numeral 82A.

The tab 45A also has another flange-like portion 83A which extends across the single leg portion of the Y-shaped configuration and serves as a reinforcing beam across the width of the main body 49A of the tab 45A; and, the main body 49A of this example is a solid metal structure on opposite sides of the beam-like flange 83A and as shown at 84A and 85A.

Figure 19:
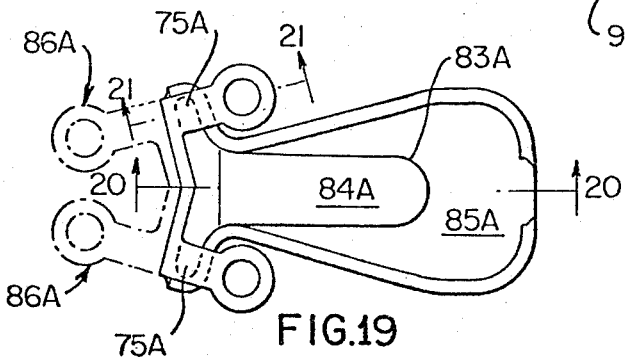
FIG. 19 is a view similar to FIG. 15 illustrating the tab of FIG. 13.
Figure 21:
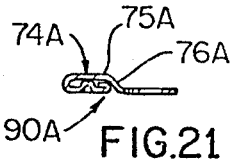
FIG. 21 is a cross-sectional view taken essentially on the line 21—21 of FIG. 19.
Figure 20:
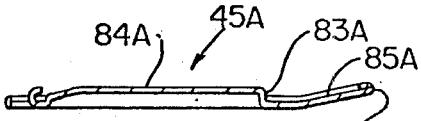
FIG. 20 is a cross-sectional view taken essentially on the line 20—20 of FIG. 19.

As will be apparent, particularly from FIG. 19 of the drawings, the grommet-like extensions 75A are initially in the dotted line positions illustrated at 86A whereupon they are bifolded into their final positions as shown by solid lines in FIG. 19 to define the double thickness portions 74A. The tab 45A also has a triple thickness portion as indicated at 90A in FIG. 21 at the location where the grommet-like portion 75A is angled downwardly as illustrated at 76A whereby the forward portion of the tab 45A has a maximum strength and rigidity.

It should be noted that the blank 80A has cut-out corner portions each defining an arcuate edge 92A which facilitates the bifolding of an associated extension 75A. This is in contract to the blank 80 which has arcuate edges 93 (see FIGS. 14 and 15) and slits 94 to facilitate bifolding of extensions 75.

Figure 22:
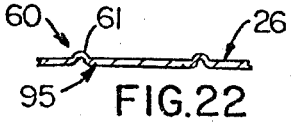
FIG. 22 is a cross-sectional view similar to FIG. 6 showing the severable panel defined by U-shaped score means extending into the wall thickness from its inside surface.

If this disclosure of the invention weakening means in the form of a score line 33 has been defined in the top wall 26, for example, and such score line 33 extends into the wall from the outside surface of such top wall. However, it will be appreciated that such weakening means or score line 33 may be defined from the inside surface thereof whereby such weakening means or score line 33 may be defined from the inside surface as illustrated at 95 in FIG. 22. It has been found that a severable panel which is to be pushed within its associated container, in the manner discolsed herein, is easier to sever when the score line extends into the wall from the inside surface thereof. This easier severing of a panel by an "inside" score line can be achieved with other types of tabs by using separate pushing means or even by pushing using one's fingers. It will also be appreciated that with an inside score line the reinforcing ridge means 60 in the form of the L-shaped ridges 61 may also serve as isolation means to isolate any burrs which may be defined upon severing the panel to define the opening 44 whereupon a person drinking directly from the container 25 (when such container is used to contain a beverage) would not be injured by possibly contacting a burr.

Having described the major portion of the easyopen top wall 26 of this invention, the description will now proceed with a brief presentation of the manner in which the wall 26 may be easily opened and the contents thereof, such as a beverage or the like, poured through the dispensing opening 44 in the usual manner or poured through the dispensing opening by drinking directly from the container 25 yet with the severable panel 41 remaining attached to the top wall 26. In particular, it is a simple matter to insert an object such as a fingernail or the like beneath the rear portion 47 of the tab 45 whereupon such tab may be pivoted about the pivot line 53. Initial pivoting of the tab 45 upwardly from the main planar portion of the top wall 26 provides an initial severing first along the arcuate lengths 46 to define spaced openings as illustrated at 50 in FIG. 5. Continued lifting of the tab 35 results in the severing action continuing along the arcuate lengths 36, along the extensions 35, and finally along the entire bight 34 whereby the opening 44 is defined as illustrated at 51 in FIGS. 9 and 10. It will also be seen that this pivoting action results in the panel 41 being severed adjacent the main width thereof which is a departure from severable tabs of the pull variety which usually are severed by first severing of a small width portion thereof and with continued pulling the severing continues progressively along the increasing tab width.

Figure 10:
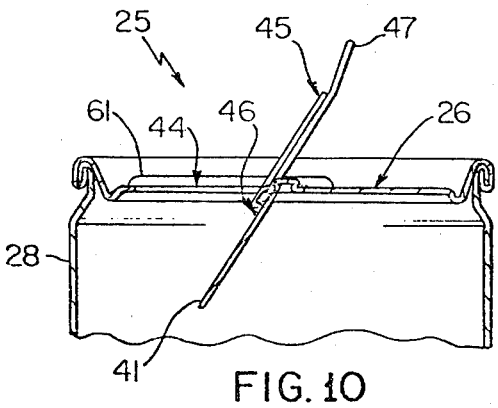
FIG. 10 is a fragmentary cross-sectional view taken essentially on the line 10—10 of FIG. 9.

It will be appreciated that the pivoting action about the pivot line 53 is an action with a substantial mechanical advantage and in this example the mechanical advantage is generally of the order of 8 to 1 for the tab 45 and panel 41 of the type which would be provided in a typical 12-ounce beverage container or can containing a carbonated beverage, or the like. Also, the severing and pivoting action illustrated in FIG. 10 is shown with the tab arranged substantially vertically; however, it will be appreciated that the pivoting could be continued beyond the vertical position to push the tab or panel 41 further into the container 25; however, this would not be necessary for satisfactory dispensing of the contents of the container.

Figure 11:
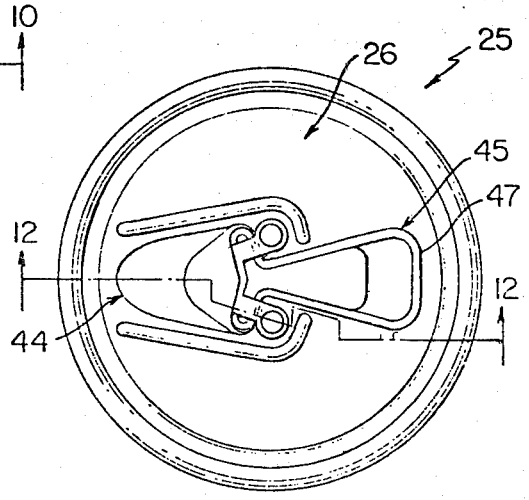
FIG. 11 is a view similar to FIG. 4 illustrating the tab returned to its original position substantially flatly against its associated top wall and with the completely defined opening in the top wall ready for unobstructed pouring or drinking therethrough.

The tab 45, for example, remains attached to its wall 26 inasmuch as the wall portion 40 holds such tab fixed thereto and the contents of the container 25 readily dispensed. The tab is preferably returned substantially flatly against the top wall 26 as illustrated in FIGS. 11 and 12 and, in general, the tab will remain substantially flatly against the wall once it is so returned. However, it will be appreciated that if desired suitable fastening means (not shown) may be provided for fastening the tab 45 in position once it is moved to the position illustrated in FIG. 12, to assure that it will be held flatly against the top wall 26.

While present exemplary embodiments of this invention, and methods of practicing the same, have been illustrated and described, it will be recognized that this invention may be otherwise variously embodied and practiced within the scope of the following claims.

What is claimed is:

1. An easy-open wall for a container comprising, an approximately U-shaped score line in said wall, said score line having a bight and a pair of extensions extending from said bight and having arcuate end lengths terminating in spaced ends, said spaced ends having a portion of said wall therebetween, said score line defining a panel which is completely severable from said wall while remaining attached at said wall portion to define an opening in said wall, and a tab attached substantially flatly against said wall, said tab having a forward portion which overlies said panel adjacent said arcuate end lengths and having a rear portion, said rear portion being easily grasped and lifted to urge said forward portion against said panel to thereby sever said panel first along said arcuate end lengths and then progressively along said extensions and bight to move said panel within said container with said wall portion holding said panel securely to said wall.

2. An easy-open wall as set forth in claim 1 in which said forward portion is defined by a pair of diverging arms having terminal ends which engage said panel upon lifting said rear portion.

3. An easy-open wall as set forth in claim 1 and further comprising a pair of rivets attaching said tab to said wall at a location between said forward and rear portions, said rivets defining a pivot line about which said tab is pivoted.

4. An easy-open wall as set forth in claim 3 in which said rivets are defined as an integral part of said wall.

5. An easy-open wall as set forth in claim 3 in which said arcuate lengths are concave on a side thereof arranged toward said bight and convex on an opposite side thereof arranged away from said bight, said rivets being attached outwardly of and adjacent said convex opposite sides of said arcuate lengths.

6. An easy-open wall as set forth in claim 5 in which said tab has front edge means on its forward portion spaced a particular distance from said pivot line and has rear edge means spaced generally of the order of eight times from said pivot line to thereby provide a mechanical advantage of roughly eight which helps to assure easy severing of said panel.

7. An easy-open wall as set forth in claim 5 in which said forward portion has a pair of double thickness portins each arranged within and adjacent the concave side of an associated arcuate length.

8. An easy-open wall as set forth in claim 7 in which said double thickness portions are defined by a pair of bifolded metal extensions each having a grommet-like terminal end portion, said grommet-like terminal end portions being attached to said wall by said pair of rivets.

9. An easy-open wall as set forth in claim 1 in which said U-shaped score line and the panel defined thereby is symmetrical about a longitudinal axis thereof and said tab has a longitudinal axis which coincides with the longitudinal axis of said score line and panel.

10. An easy-open wall as set forth in claim 1 and further comprising reinforcing ridge means in said wall arranged outwardly of said U-shaped score line.

11. An easy-open wall as set forth in claim 10 in which said rigid means comprises a pair of roughly L-shaped ridges each having a long arm portion arranged substantially parallel to an associated one of said pair of extensions.

12. An easy-open wall as set forth in claim 11 in which each of said L-shaped ridges has a wall thickness substantially equal to the remainder of said wall.

13. An easy-open wall as set forth in claim 1 in which said tab is made from a single piece of sheet metal.

14. An easy-open wall as set forth in claim 13 in which said tab has a flange around the major portion of its outer periphery which provides added strength and rigidity therefor.

15. An easy-open wall as set forth in claim 1 in which said U-shaped score line extends into said wall from the outside surface thereof.

16. An easy-open wall as set forth in claim 1 in which said U-shaped score line extends into said wall from the inside surface thereof.

17. An easy-open wall as set forth in claim 1 made of a metallic material containing aluminum and said tab thereof is also made of a metallic material containing aluminum.

18. An easy-open wall for a container comprising, an approximately U-shaped score line in said wall, said score line having a bight and a pair of extensions extending from said bight and having arcuate end lengths terminating in spaced ends, said spaced ends having a portion of said wall therebetween, said score line defining a panel which is completely severable from said wall while remaining attached at said wall portion to define an opening in said wall, a roughly Y-shaped tab attached substantially flatly against said wall, said tab having a forward portion which overlies said panel adjacent said arcuate end lengths and having a rear portion, said forward portion being defined by a pair of diverging arms having terminal ends which engage said panel upon lifting said rear portion, and a pair of rivets attaching said tab to said wall at a location between said forward and rear portions, said rivets defining a pivot line about which said tab is pivoted, said rear portion being easily grasped and lifted to urge said forward portion against said panel to thereby sever said panel first along said arcuate end lengths and then progressively along said extensions and bight to move said panel within said container with said wall portion holding said panel securely to said wall.

19. An easy-open wall as set forth in claim 18 in which said arcuate lengths are concave on a side thereof arranged toward said bight and convex on an opposite side thereof arranged away from said bight, said rivets being attached outwardly of and adjacent said convex opposite side of said arcuate lengths, and said tab also has front edge means on its forward portion spaced a particular distance from said pivot line and has rear edge means spaced generally of the order of eight times from said pivot line to thereby provide a mechanical advantage of roughly eight which helps to assure easy severing of said panel.

20. An easy-open wall as set forth in claim 19 in which said forward portion has a pair of double thickness portions with said double thickness portions being defined by a pair of bifolded metal extensions each having a grommet-like terminal end portion, said grommet-like terminal end portions being attached to said wall by said pair of rivets.

* * * * *